United States Patent [19]

Andersson et al.

[11] Patent Number: 4,911,058

[45] Date of Patent: Mar. 27, 1990

[54] DEPTH CHARGE FUZE

[75] Inventors: Sten E. Ö Andersson; Jan T. Olsson, both of Landskrona; Jan Björk, Kågeröd, all of Sweden

[73] Assignee: SA Marîne AB, Landskrona, Sweden

[21] Appl. No.: 346,419

[22] Filed: May 1, 1989

[51] Int. Cl.[4] ..... F42B 3/10

[52] U.S. Cl. ..... 86/22; 102/326; 102/399; 102/202.1; 102/275.11

[58] Field of Search ..... 86/22; 102/326, 399, 102/202.1, 275.11

[56] References Cited

U.S. PATENT DOCUMENTS

| | | | |
|---|---|---|---|
| 3,889,598 | 6/1975 | Belsley | 102/202.5 X |
| 4,369,709 | 1/1983 | Backstein | 102/215 |
| 4,478,149 | 10/1984 | Backstein | 102/215 |
| 4,584,925 | 4/1986 | Culotta et al. | 102/275 |

FOREIGN PATENT DOCUMENTS

| | | |
|---|---|---|
| 0149791 | 3/1984 | Norway . |
| 0400377 | 3/1978 | Sweden . |

*Primary Examiner*—Peter A. Nelson
*Attorney, Agent, or Firm*—Nils H. Ljungman

[57] ABSTRACT

A depth charge fuze includes a piston in a cylinder sealingly and displaceably guided to actuate a firing mechanism against atmospheric pressure within the cylinder on one side of the piston. The piston is operatively connected to a balancing device for balancing in axial direction. At the other side of the piston there is provided a pressure chamber connected to the surroundings by means of a number of throttling passages with valves depending on the surrounding water pressure for closing up the passages on different levels of water pressure. A shearing means retains the piston in a rest position up to a predetermined maximum pressure drop over the piston.

7 Claims, 2 Drawing Sheets

DEPTH CHARGE FUZE

The invention relates to a depth charge fuze comprising a piston sealingly and displaceably guided in a cylinder to actuate a firing mechanism against atmospheric pressure in the cylinder at one side of the piston, a pressure chamber a the other side of the piston, the internal pressure thereof being dependent on the surrounding pressure, and a shearing means for retaining the piston in a rest position up to a predetermined maximum drop of pressure over the piston.

The Swedish patent specification No. 400,377 discloses this type of fuze. It is cheap and uncomplicated but suffers from a drawback which is not negligible in this connection: it is not chock safe, i.e. it is not resistant to detonation waves created by other depth charges detonating close thereto. Depth charges are preferably dropped in a pattern to achieve maximum effect and then the detonation wave from one depth charge must rest release another depth charge in the vicinity thereof.

An object of the invention is to provide a fuze of the type referred to above which is constructed so as to be chock safe. In this connection chock safe means that the fuze mounted in a depth charge at a distance from a detonating depth charge, which is larger than a specified minimum distance (for instance 10 meters), cannot be triggered by the pressure waves of detonation, provided that there is left a distance exceeding a specified minimum distance (for instance 5 meters) to the preset depth of detonation when a pressure wave reaches the depth charge.

To achieve said object the fuze of the type referred to above according to the invention has obtained the characterizing features appearing from claim 1.

Then the chock safe function is based on the piston being non-sensitive to acceleration by coaction with counter weight means to be balanced in axial direction; the effective mass of the piston being constant (so as to be balanced as indicated above) by allowing only air, not water, to contact the piston through an air connection; and pressure waves being prevented from reaching the piston (to an acceptable degree only) through a system of throttling passages and valves. Preferably, the fuze is protected against the primary wave by an outer casing rigidly secured to the depth charge and provided with water inlet passages arranged in a suitable way.

It is also preferred that the fuze is resiliently mounted in a cavity in the depth charge so as to be further protected against the influence of the primary wave.

Figure 1:
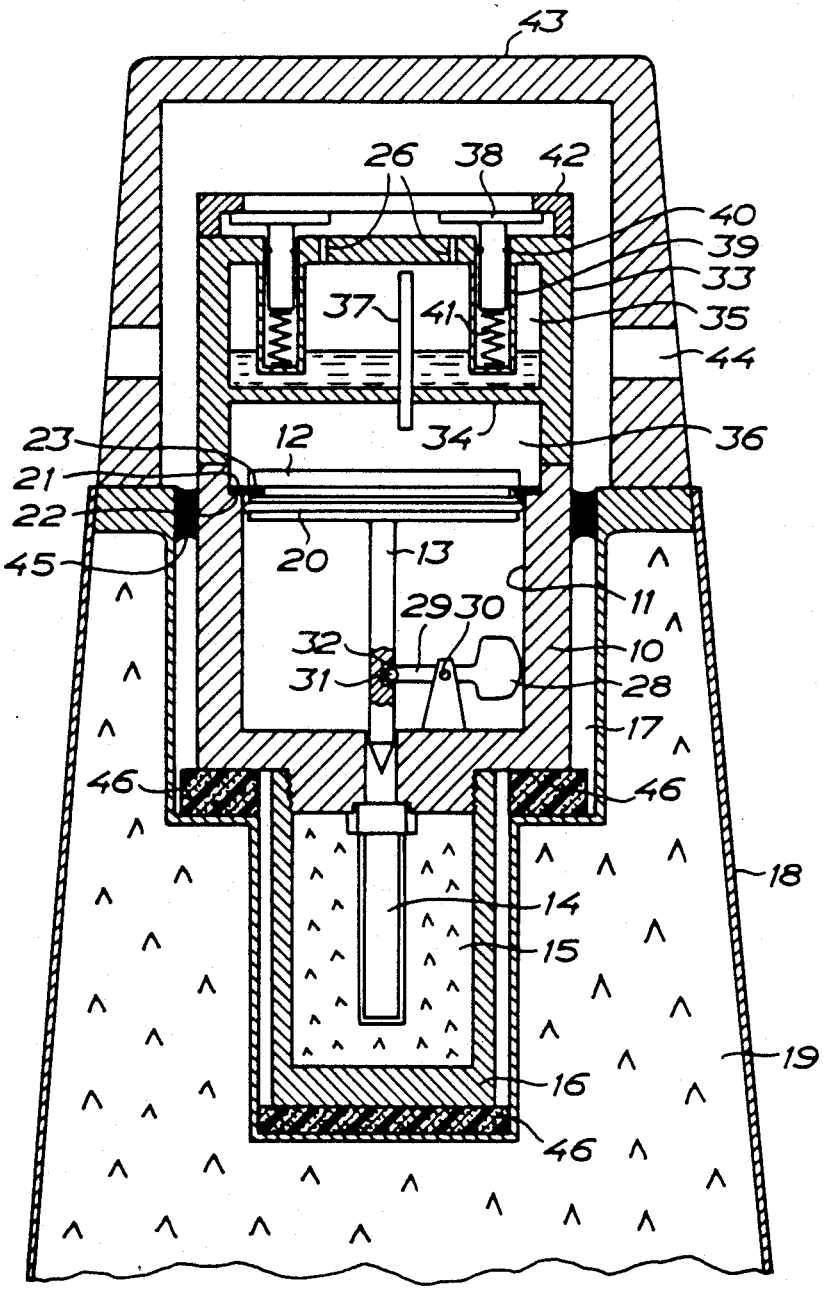
Figure 2:
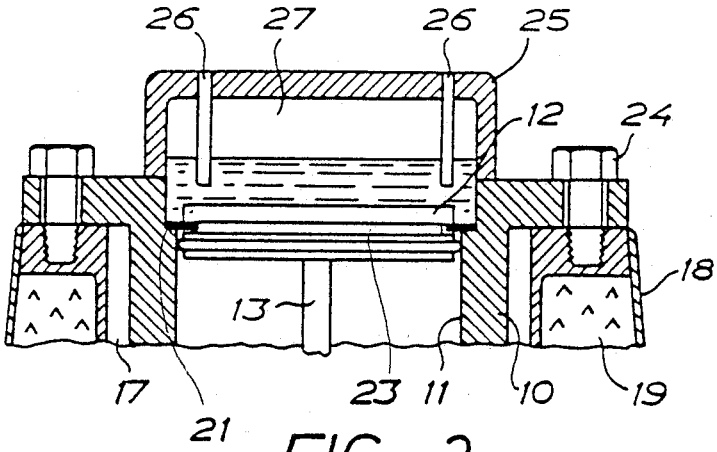
Figure 3:
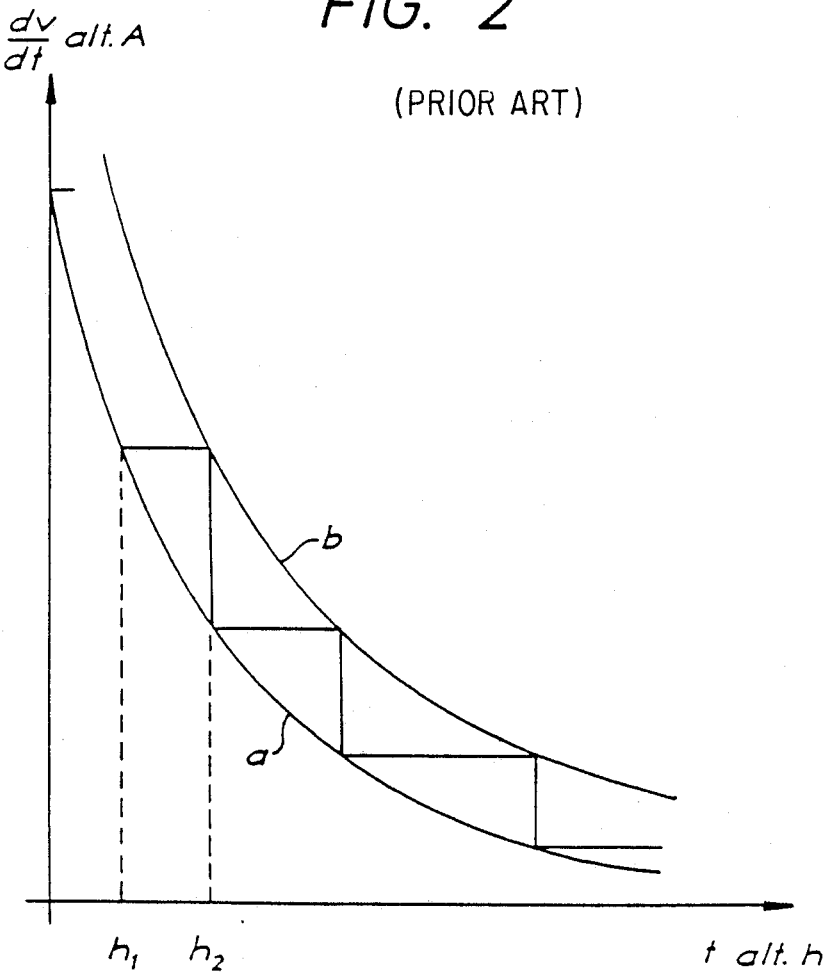

In order to explain the invention in more detail reference is made to the accompanying drawing in which FIG. 1 is an axial sectional view of a fuze according to the invention mounted in a depth charge partly shown, FIG. 2 is a fragmentary view according to FIG. 1 of a prior art fuze, and FIG. 3 illustrates diagrammatically the flow of air to the pressure chamber.

Referring to FIG. 1 the fuze comprises a housing 10 forming a cylinder bore 11 guiding a reciprocable piston 12. The piston has a piston stem 13 formed as a firing pin, the tip thereof being directed towards a mechanical detonating tube 14 arranged in a primary charge 15 which is encased in a casing 16 screwed on the housing 10. The housing 10 and the casing 16 are mounted in a cavity 17 in a depth charge 18 enclosing a main charge 19.

The piston is provided with an O-ring 20 sealing against the cylinder bore 11, and the space in the housing 10 at the lower side of the piston contains air of atmospheric pressure. Normally, the piston is prevented from downward movement through the cylinder bore 11 by a shear device comprising a shear sheet 21, placed on a shoulder 22 in the housing 10 and extending into an annular groove 23 in the piston 12. Thus, the housing and the piston form a cutting tool for the sheet 21. In practice a safety mechanism is always provided to prevent the firing pin 13 from striking the detonating tube 14, the detonating tube for instance being laterally displaced in relation to the firing pin 13 in the normal position. However, the safety mechanism is not relevant to the present invention and therefore it is not shown in more detail here.

Before further describing the fuze according to the invention reference is made to FIG. 2 showing the prior art embodiment of the fuze. The housing 10 is rigidly secured to the depth charge 18 by means of a bolt connection 24 and the upper side of the housing 10 is joined to a cap 25 which is provided with a number of inlet passages 26 for the water. The passages end far below in the space defined by the cap 25 and the piston 12, herein referred to as the pressure chamber and designated 27, so that the air captured in the pressure chamber is prevented from escaping therefrom, said air being retained and being progressively compressed as water enters the pressure chamber 27. This happens when the depth charge has been dropped, and then a pressure will be created in the pressure chamber 27, corresponding to the surrounding pressure of the water. The force acting on the piston 12 thus is increasing as the depth charge is sinking, and finally the sheet 21 will be sheared off between the piston 12 and the housing 10 enabling the pressurized air enclosed in the pressure chamber 27 to accelerate the piston 12 downwards so as to make the firing pin 31 penetrate the detonating tube 14 and initiate the chain of detonations. It is possible to adjust the depth at which this action shall take place by forming the groove 23 in the piston 12 as sectors and forming the sheet 21 correspondingly in sectors such that larger or smaller lengths of sheet can be inserted into the groove to be sheared off. Thus, it is possible to define the shear force and consequently the pressure in the pressure chamber 27 required for shearing to take place said pressure in turn being dependant on the depth of the depth charge.

As stated above a simple depth charge fuze of the type shown in FIG. 2 is not chock safe, but is invitibly brought to (early) detonation by existing pressure waves from detonations. As registered at a distance of for instance 10 to 40 meters from a detonating depth charge (with 50 to 150 kg explosives) these waves are of two kinds:

1. A primary wave reaching its maximum value of the order of 10 MPa practically momentarily (rise time 0) and decaying to a negligible value in just a few milliseconds.

2. Several secondary waves arriving at intervals of about 0.5 s, the first approximately 0.5 s after the primary wave. The maximum pressure of the secondary waves can be of the order of 0.2–1.5 MPa, and the duration thereof can be approximately 0.1 s.

The pressure waves propogate in the water at approximately 1500 m/s.

There are two reasons for these detonation waves to fire the simple prior art depth charge fuze:

(a) The primary and/or secondary waves penetrate into the passages 26 and cause a drastic pressure increase in the pressure chamber 27 resulting in release of the fuze.

(b) When the primary wave strikes and passes the depth charge this will be exposed to an enormous acceleration, the size thereof being approximately 10,000 $m/2^2$ such that the depth charge in a fraction of a millisecond will move over a distance of the order of 2 mm. Then, the piston 12 in the fuze due to the mass thereof will be exposed to forces of inertia which ere so large that the sheet 21 is sheared off resulting in release of the fuze. As an alternative the piston 12 can rise (a few tenth of a millimeter) from the sheet 21, potential energy being imparted to the piston to such extent that the sheet will be cut in the return movement.

To neutralize the influence of the waves of detonation on the fuze as stated above, the fuze according to the invention is provided with complementary devices so as to accomplish chock safety. Referring again to FIG. 1 these devices will be described in more detail.

In the interior of the housing 10 the fuze s provided with one or more counterweight means each of which comprises a balancing weight 28 at one end of double armed lever 29 pivotally mounted in a bearing 30 free of play, and at the other end movably connected to the firing pin 13 by means of a pin 31 fitting without play but with low friction in a groove 32 in the firing pin. The bearing 30 is rigidly mounted in the housing 10. When the piston 12 is moving downwards the balancing weight 28 is forced to move upwards, and vice versa. The balancing weight or weights if more than one are provided must be dimensioned in such a way that the piston 12 at axial acceleration will have no or just a slight tendency to move in relation to the housing 10.

In addition to the counterweight means the fuze according to the invention comprises also a device for pressure wave filtering but before describing this device a theoretical analysis is required and in this connection reference is again made to FIG. 2.

Assume that a depth charge with a fuze of the embodiment according to FIG. 2 is sinking at constant speed (a depth charge reaches the final speed very rapidly after the impact into the water, in a few meters). Assume further that the inlet passages 26 are provided with some type of mechanism by means of which the total area thereof, referred to as A, is made to vary with the water depth It is desired that the pressure in the pressure chamber 27 has a constant or rather a negligible slip in relation to the surrounding pressure making the pressure drop over the passages 26, referred to as $\Delta p$, constant or negligible. If the volume of water flown into the pressure chamber 27 through the passages 26 in the period t is referred to as v, the flow through the passages by definition is equal to the derivative of v with respect to time t (as a suggestion counted from the start of the sinking), i.e. dv/dt. This derivative can be calculated from the general gas laws and by estimating the exchange of heat between the air enclosed in the pressure chamber 27 and the surfaces defining the chamber. Then a graph for dv/dt as a function of time t having essentially the form shown by the graph a in FIG. 3 is obtained. This graph is based on the fact that the pressure drop p is considered constant (for instance 1 to 2 mwp).

The question is now how the total area A of the passages 26 is to be varied with the time t (or the depth referred to as h) to obtain a flow graph according to a in FIG. 3. For flow of water through passages, of dimensions such that the viscosity of the water is negligible (non-friction flow), which is relevant here it is a good approximation to assume that dv/dt=constant X A p. Thus, if p is made constant the area A will be proportional to the flow dv/dt. Thus, the graph a in FIG. 3 may as well represent the required variation of the area A of the passages 26 over the depth h to obtain a constant pressure drop over the passages cut if 1 to 2 wwp is a negligible pressure slip (which it is here) why then make the area A vary?. It would be much easier to make the area constant and instead allow decrease of p from 1 or 2 mwp at the beginning of the sinking to approximately 0 at the end of the sinking. The answer is that there must be provided a small heavily throttling area in the passages 26 to prevent the pressure waves from a detonation from penetrating into the pressure chamber 27 as will be explained in more detail below.

According to elementary underwater detonatics primary and secondary waves in spite of completely different duration and pressure have approximately the same impulse, i.e. pdt. Since the penetration through a passage 26 follows the formula v=constant pdt (non-friction flow), where v relates to the penetrated volume during the time $\Delta t$ and $\Delta p$ is the pressure drop over the passage, the effect is that a low pressure of long duration is a more difficult case (gives a larger $\Delta v$) than a high pressure of short duration even though the impulses are the same. In other words, it is most difficult to filter out the secondary waves.

A secondary wave can be conservatively approximated as a constant low pressure acting during a certain period, to impact to the impulse the correct value, for instance 2 bar during 0.1 s (50 kg TNT of a distance of 20 m). Assume that such a wave is allowed to penetrate through the inlet passages 26 and cause a rise of pressure in the pressure chamber 27, but it is not accepted that this rise of pressure increases over a certain value (for instance 4 mwp) depending in how many meters of early release that can be accepted for a depth charge fuze. By applying the general gas laws and the formula for non-friction flow through passages it can be shown that the area A of the passages has to decrease at increasing depth in accordance with a graph essentially of the form of the graph b in FIG. 3. By appropriate dimensioning it is possible in practice to achieve that the graph b is well above the graph a such that there is between them an "allowed zone" for the passage area A, which is characterized by the slip of pressure within the pressure chamber 27 in relation to the surrounding water pressure being negligible while the rise of pressure caused in the pressure chamber by a secondary wave is acceptable.

In practice it is difficult to form an area A decreasing continuously with the depth of water. In that case it is easier to allow the area A to decrease stepwise utilizing the "allowed zone". Such a step graph is indicated in FIG. 3. At tee depths $h_1$, $h_2$ etc. the area is allowed to decrease momentarily for instance by having from the beginning a plurality of passages 26 and then by means of suitable water pressure activated mechanisms closing the passages step by step. This is the technique chosen for the chock safe fuze according to the invention and the manner in which this is achieved will now be described in more detail with reference again to FIG. 1.

The device for filtering pressure waves is built around a housing 33 replacing the cap 25 in FIG. 1. A partition 34 is provided in the housing so that the housing forms an upper chamber 35 and a lower chamber 36 interconnected by a non-throttling passage 37 and forming together a pressure chamber having the same function as the pressure chamber 27 in FIG. 2. The passage 37 comprises a tube, the top end thereof being close to the ceiling of the chamber 35, the lower end thereof in the chamber 36 ending at a distance above the piston 12. The chamber 35 comprises inlet passages 26 exactly as the chamber 27 in FIG. 2. The purpose of arranging the two chambers as described is to maintain equal pressures in both chambers, chamber 36, however, having only compressed air and not water which remains in the chamber 35 due to the fact that the passage 37 is extended above the partition 34 provided as a bottom in the chamber 35. Thus, the water will be trapped in the chamber 35. At a sufficiently large depth the water in the chamber 35 will, of course, "over-flow" through the passage 37 into the chamber 36 but the dimension of the chambers can be such that this happens outside the working area of the fuze.

The upper orifices of the inlet passages 26 can be closed by means of disc valves 38, the valve stem thereof being displaceably guided in a cylindric blind hole 39 in the ceiling of the housing 33 with a sealing 40 provided between the valve stem and the wall defining the blind hole. Within the blind hole 39 a compression spring 41 is provided biasing the valve in an outward direction, though complete displacement outwards of the valve is prevented by an abutment 42 on the housing 33. When the valve is kept engaged with the abutment in the rest position, the disc of the valve is a few millimeters above the orifice of the associated passage 26 leaving the flow of water completely unrestricted. There is atmospheric pressure in the blind hole 39 and at a defined water depth the force of the spring 41 will be overcome so that the valve 38 will descend and close the opening of the associated passage 23 at the disc. By dimensioning the valves 38 in such a way that this closening or activation of the valves takes place at different levels of water pressure, i.e. at different depths for the several valves the step graph shown in FIG. 3 can be achieved to control the total area of the inlet passages 26. In practice four inlet passages 26 with valves and one passage 26 without a valve preferably are provided to achieve the step graph of FIG. 3.

In the embodiment shown the fuze is protected from the primary pressure wave which otherwise could damage the precision mechanisms or cause an elastic deformation of the complete fuze with unpredictable consequenses, by means of an outer casing 43 rigidly connected to the depth charge 18. Inlet passages 44 for the water are provided in the casing, which are dimensioned such that the pressure within the casing will have a negligable slip in relation to the surrounding pressure during the sinking of the depth charge. The ability of the passages 44 to filter out the primary wave is, however, good. The function is also based on the fact that the air existing initially on one hand between the fuze and the casing 43 and on the other hand in the cavity 17 of the depth charge will never leak out bu will be compressed as more water penetrates into the passages 44. As further resource for bringing down the strain on the balancing mechanism described above, the fuze is "floating" by mean of an annular rubber spring 45 by means of which the housing 10 of the fuze is connected to the depth charge 18. Thus, acceleration of the depth charge propagates only reduced extent to the fuze. The rubber spring 45 should have axial passages (not shown) so that water can flow unrestrictedly from the space inside the casing 43 add the cavity 17. To prevent the "rigid" water (at movements of the fuze the duration of which is of the order of milliseconds) in the cavity 17 from putting the floating suspension of the fuze out of order bodies 46 made of a soft polymer, such as polyurethane, with closed cells are placed between the fuze and the wall defining the cavity 17. By this arrangement "air cushions" will be formed imparting freedom of movement to the fuze so as to swing in the rubber spring 45 in relation to the depth charge and the casing 43. In the space in the causing no such bodies are required because the air trapped therein and in the cavity 17 collects in the top of the casing 43 and forms an air cushion there.

The volume of the cavity 17, the volume at the top of the casing 23 and the location of the passages 44 are such that the air cushion is primarily located above the passages 26 quickly after the depth charge is dropped in water. Since water will be primarily directed to the passages 26 after the depth charge is dropped in the water, the assumption, as discussed above, regarding the viscosity of water as it flows through the passages 26 remain valid.

We claim:

1. Depth charge fuze, comprising a piston (12) sealingly and displaceably guided in a cylinder (11) to actuate a firing mechanism (13, 14) against atmospheric pressure in the cylinder at one side of the piston, a pressure chamber (36) at the other side of the piston, the internal pressure thereof being dependent on the surrounding pressure, and a shearing means (21 for retaining the piston in a rest position up to a predetermined maximum drop of pressure over the piston; characterized in that the piston (12) is operatively connected to a balancing device (28, 29) for providing balance in axial direction, and that the pressure chamber (36) is connected to an antechamber (35) by an air connection (37), the antechamber being connected to the surroundings by means of a number of throttling passages (26) with a number valves (38) to be actuated in dependence on the surrounding water pressure for closing the throttling passages at different water pressures.

2. Fuze according to claim 1, characterized in that the air connection ((37) comprises a ventilating passage extending from the upper part of the antechamber (35) to the pressure chamber (36).

3. Fuze according to claim 1, characterized in that the valves (38) of the throttling passages (26) comprise disc valves which are spring biased against the surrounding water pressure.

4. Fuze according to claim 3, characterized in that the valve stem of the disc valves (38) is sealingly and displaceably guided in a cavity (39) at atmospheric pressure in which the biasing spring (41) is provided.

5. Fuze according to claim 1, characterized in that the cylinder (11) with the piston (12) provided therein, the fuze mechanism (13, 14) and the pressure chamber (36) with the antechamber (35) are arranged in an element (10, 16, 33) resiliently connected to the depth charge.

6. Fuze according to claim 1, characterized in that it is arranged in a cavity (17) in the depth charge (18) and that a casing (43) with inlet passages (44) for the surrounding water is provided for enclosing the fuze.

7. Fuze according to claim 6, characterized in that bodies (46) of a soft polymer with closed cells are provided between the fuze and the walls defining the cavity.

* * * * *

UNITED STATES PATENT AND TRADEMARK OFFICE

CERTIFICATE OF CORRECTION

PATENT NO. : 4,911,058

DATED : March 27, 1990

INVENTOR(S) : Sten Einar Östen ANDERSSON, et al.

It is certified that error appears in the above-identified patent and that said Letters Patent is hereby corrected as shown below:

On the title page:

Under the Foreign Priority data section, the following should be added:

--International Application No. PCT/SE86/00494, filed on October 29, 1986--.

In column 1, line 8, after "chamber", delete "a" and insert --at--.

In column 3, line 11, after "which", substitute 'ere' with --are--.

In column 3, line 22, after "fuze", substitute 's' with --is--.

In column 3, line 48, after "depth" insert --.--.

In column 4, line 10, substitute 'wwp' with --mwp--.

In column 4, line 39, after "depending", substitute 'in' with --on--.

In column 4, line 58, after "At", substitute 'tee' with --the--.

In column 5, line 60, after "out", substitute 'bu' with --but--.

In column 5, line 64, after "by", substitute 'mean' with --means--.

UNITED STATES PATENT AND TRADEMARK OFFICE

CERTIFICATE OF CORRECTION

PATENT NO. : 4,911,058

DATED : March 27, 1990

INVENTOR(S) : Sten E. O. Andersson, et al.

It is certified that error appears in the above-identified patent and that said Letters Patent is hereby corrected as shown below:

In column 6, line 12, after "the", substitute 'causing' with --casing--.

Signed and Sealed this

Third Day of November, 1992

*Attest:*

DOUGLAS B. COMER

*Attesting Officer*

*Acting Commissioner of Patents and Trademarks*